US005198860A

United States Patent [19]

Yamanaka et al.

[11] Patent Number: 5,198,860

[45] Date of Patent: Mar. 30, 1993

[54] IMAGE FORMING APPARATUS INCLUDING MEANS FOR DETECTING AMOUNT OF TONER

[75] Inventors: Hiromichi Yamanaka, Kawasaki; Takeji Gima, Machida; Takashi Soya, Kawasaki; Akihiro Shibata, Yokohama, all of Japan

[73] Assignee: Canon Kabushiki Kaisha, Tokyo, Japan

[21] Appl. No.: 593,646

[22] Filed: Oct. 4, 1990

[30] Foreign Application Priority Data

Oct. 4, 1989 [JP] Japan ..... 1-260708

[51] Int. Cl.[5] ..... G03G 21/00

[52] U.S. Cl. ..... 355/246; 118/653; 355/208; 355/251

[58] Field of Search ..... 355/245, 251, 253, 246, 355/208; 118/653, 656, 657, 658; 430/102, 122

[56] References Cited

U.S. PATENT DOCUMENTS 4,395,476 7/1983 Kanbe et al. ..... 430/102
4,786,869 11/1988 Kanai et al. ..... 118/663 X
4,972,230 11/1990 Wayman ..... 355/246

FOREIGN PATENT DOCUMENTS 3210870 9/1988 Japan .

*Primary Examiner*—A. T. Grimley
*Assistant Examiner*—Thu A. Dang
*Attorney, Agent, or Firm*—Fitzpatrick, Cella, Harper & Scinto

[57] ABSTRACT

The present invention provides an image forming apparatus in which the first lead wire which transmits a detection signal indicating the remaining amount of toner in the developing unit into a circuit for comparison with the reference voltage, and the second lead wire are arranged parallel. One end of the second lead wire is connected to the reference voltage generating side and the other end is electrically open.

12 Claims, 9 Drawing Sheets

IMAGE FORMING APPARATUS INCLUDING MEANS FOR DETECTING AMOUNT OF TONER

BACKGROUND OF THE INVENTION

1. Field of the Invention

This invention relates to electronic photocopiers, electrophotographic laser beam printers, and other image forming apparatus which form electrostatic latent images and develop them with toner.

2. Related Background Art

A developing sleeve carrying a thin layer of toner is installed as a developing unit of the image forming system, facing an image carrier with a greater distance therebetween than the thickness of the thin layer. Then, bias voltage having an AC component is applied to the developing sleeve. The vibrating electric field formed between the image bearing member or image carrier and sleeve causes toner to reciprocate between them. Thus, latent images formed on the image carrier are made visible by developing apparatus. This kind of developing systems have been known from, for example, U.S. Pat. No.4,395,476.

In those developing systems, in order to detect the remaining amount of toner, an electric conductor is installed in the developing unit facing the sleeve to use induced voltage produced in the conductor via toner according to the voltage applied to the developing sleeve. In this popular method, the change in capacitance between the developing sleeve and conductor which results from the variation in the amount of toner interposing between them is detected with voltage. Then, the voltage is compared with a reference voltage.

In FIG. 1, bias voltage, having an AC component the power supply 3 has developed (a DC voltage component is superimposed), is applied to the developing sleeve which rotates in arrow direction to carry toner 4 and applies the toner to the electronic photosensitive material 0 rotating in arrow direction. The detecting conductor 2 and developing sleeve 1 correspond to pole plates of capacitor, respectively. The capacitance varies with the amount of toner 4 interposing between the detecting conductor and developing sleeve. A signal voltage developed in the detecting conductor 2 is converted into a DC voltage $V_{DC}$, through the rectification circuit 5 and capacitance-voltage conversion circuit 6. The voltage $V_{DC}$ value corresponds with the said amount or the amount of toner in the developing unit. The reference voltage generation circuit 7 inputs reference voltage $V_s$ and detected DC voltage $V_{DC}$ into the comparison ciucuit 8 to check which value is larger. When the remaining amount of toner becomes lower than the given amount and voltage $V_{DC}$ becomes less than $V_s$, the remaining amount detecting indication circuit 9 is activated to indicate warning information.

The DC voltage $V_{DC}$ is affected with the variation in peak-peak voltage of AC voltage $V_{pp}$ applied to the developing sleeve 1. Normally, the $V_{PP}$ value the AC power supply 3 develops varies by approximately +/−10% for its performance sake. Therefore, even if the amount of toner is constant, the DC voltage $V_{DC}$ detected varies with the AC bias voltage variation. Therefore, warning information prompting for comparison with the reference voltage $V_s$ is output with the different amounts of toner. This is a significant drawback.

A well-known alternative method is that a capacitor having a reference capacitance is used to form a reference voltage signal, so that the detecting efficiency of the remaining amount will not be affected even if AC bias voltage varies (for instance, Japanese Patent Laid-open No. 63-210870). FIG. 2 shows the outline of the system.

In FIG. 2, the reference voltage generating circuit is equipped with a capacitor 10*a* having capacitance $C_s$ similar to the amount of toner to be detected. When the power supply 3 applies bias voltage containing an AC component to the developing sleeve 1, said bias voltage is applied to one electrode of the capacitor 10*a* at the same time. Then, voltage occurs at another electrode of the capacitor 10*a*, which is converted into DC reference voltage $V_s$ through the rectification circuit 10*b* and capacitance-voltage conversion circuit 10*c*. The reference voltage $V_s$ and detecting voltage $V_{DC}$ are compared in the comparison circuit 8 to detect amount of toner. This method has an advantage that voltage variation in peak-peak voltage of bias voltage $V_{pp}$, if it occurs, would affect voltages $V_{DC}$ as well as $V_s$. Therefore, variation in peak-peak voltage $V_{pp}$ is ignorable.

The developing unit 11 which incorporates a detecting conductor 2 (which is also equipped with the said sleeve 1) is installed away from the toner remaining amount detecting circuit 12 comprising the said circuits 5, 6, 8, 10*a*, 10*b*, and 10*c*. On the other hand, the voltage signal corresponding to the amount of toner in the developing unit 11 which is induced into the detecting conductor 2 is a weak signal. Therefore, a shielding wire 16 (FIG. 3) is used to prevent noise from mixing with the weak signal, so that the signal can be transmitted to the toner remaining amount detecting circuit 12. The shielding wire 16 consists of a lead wire 13 for the said signal, an insulation layer 15 made from synthetic resin which encapsulates the lead wire 13, and an electric shielding member 14 which encapsulates the insulation layer 15. The shielding member 14 is usually made from texture of fine metallic lines. Whatever is made into the shielding member 14, it is electrically grounded, However, there is a drawback that floating capacitance developed between lead wire 13 and the shielding member 14 affects detection voltage.

In FIG. 3, the developing unit 11, or the assembly of the developing unit and photosensitive drum D is detachable from the imaging system main unit 17. The detachable connector 18 connects the detecting conductor 2 and lead wire 13. The detachable connector 19 connects the sleeve and a lead wire 20 coming from the power supply 3 which applies bias voltage.

SUMMARY OF THE INVENTION

This invention intends to provide an imaging system capable of detecting the amount of toner accurately.

Another object is to prevent occurrence of a detection error due to floating capacitance between the lead wire detection signal and the shielding member.

The other objects and features of this invention would be clarified with the description below.

DESCRIPTION OF THE PREFERRED EMBODIMENTS

Figure 4:
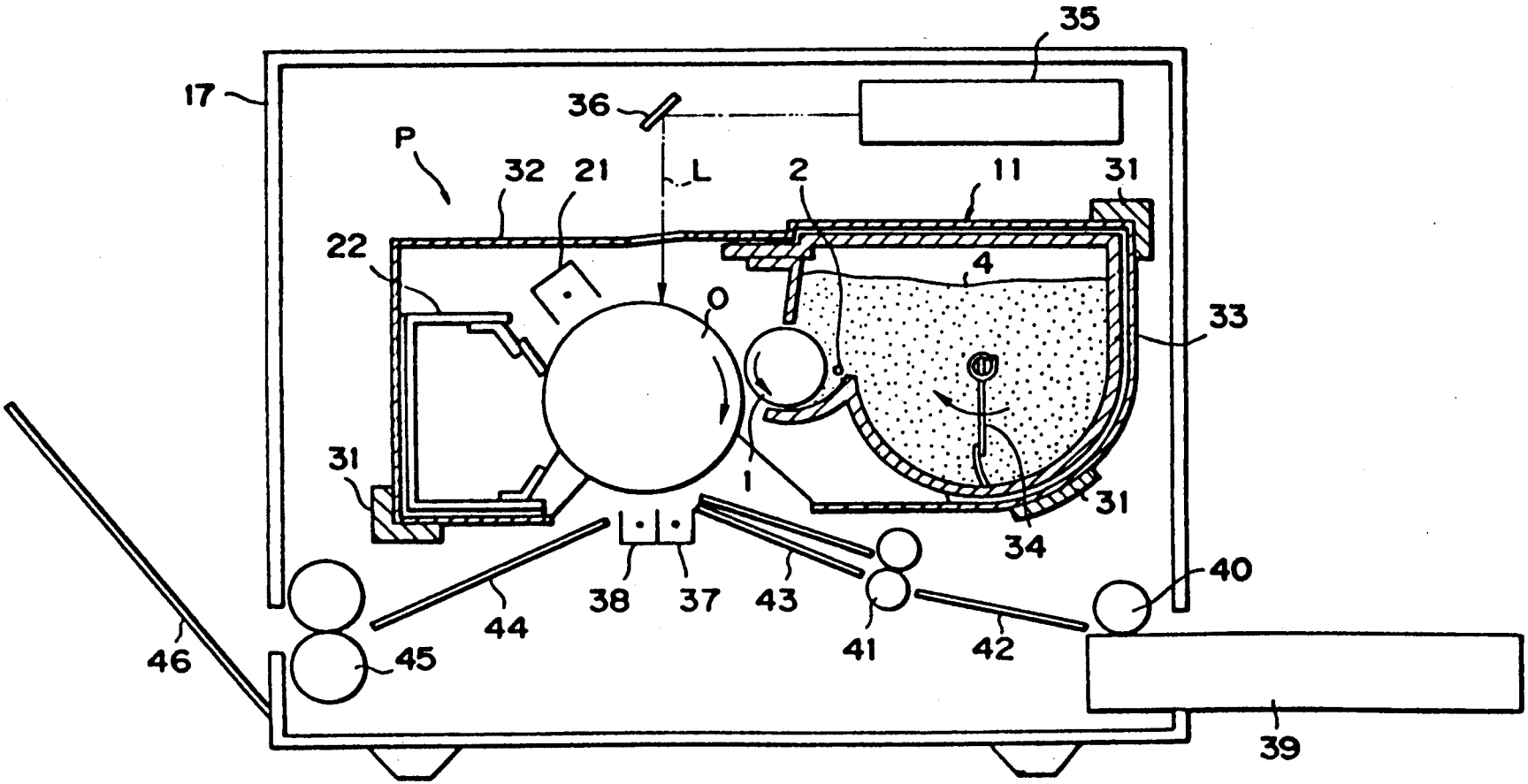
FIG. 4 is an explanatory drawing of an image forming apparatus to which this invention is applicable.

In FIG. 4, the imaging system main unit 17 consists of an optical unit, a transfer printer transport unit, a transfer printer, a fixing unit, and a guide member 31 which guides detachment or attachment of a process cartridge P from or to the main unit 30, which are described below.

The process cartridge P consists of an electronic photosensitive body o which rotates in arrow direction, a charger 21 which charges the photosensitive body o uniformly, a developing unit 11 which develops electrostatic latent images formed on the photosensitive body o, and a cleaner 22 which removes the remaining toner from the surface of the photosensitive body o. These means are supported as a unit in a frame 32.

The process cartridge P is mounted to or dismounted from the main unit 17 by sliding it along the guide members 31. With this feature, if toner in the developing unit 11 has run out, an operator can extract the process cartridge P from the main unit 17 and mount another process cartridge P containing a developing unit filled with toner into the main unit 17 therefor. In addition, when the process cartridge P accommodating toner of an intended color is mounted into the main unit 17, an image colored intendedly can be output.

The developing unit 11 is equipped with a toner container 33 accommodating toner T, an agitating member 34 in the toner container 33 which is freely rotatable, and a developing roller or sleeve 1 installed at the aperture of the container 33. The agitating member 34 rotates in arrow direction to agitate toner T in the container 33, and transports toner into the developing roller 1. The developing roller 1 carries toner, rotates in arrow direction, applies toner to a latent image formed on the photosensitive body o, then transports it to the developing area.

The imaging operations are described below. The photosensitive body o is charged with electricity by the charger 21, then scanned and exposed by a laser beam which has been modulated according to a recorded image information signal. Thus, a latent image is formed. The laser beam L is produced by a well-known optical unit comprising a semiconductive laser, a rotary polygon mirror, and a f-0 lens, and then reflected towards the photosensitive body o by a mirror 36.

Said latent image is developed by the developing unit 11 as mentioned previously. A toner image obtained is transferred onto paper or any other transfer material by operation of a transfer charger 37. Then, the transfer printer is separated from the photosensitive body by operation of a separating discharger 38. A unit which transports the transfer printer comprises a cassette 39 accommodating the transfer material, a pick-up roller 40 which picks up the transfer material from the cassettes 39, a registration roller 41 which transports the transfer material into the transfer area in synchronization with the movement of a toner image, and transport guides (42, 43, and 44).

The transfer material separated from the photosensitive body 1 enters the fixing unit 45 passing through the guide 44. Then, a toner image is fixed onto the transfer material. After fixing, the transfer material is ejected onto a tray 46.

In the illustration, a laser beam is exposed on the photosensitive body o, but alternatively, a light emitting diode array driven by an image signal may be used to expose the photosensitive body, or an original image may be exposed directly onto the photosensitive body via lens.

In FIG. 4, the process cartridge P, including the photosensitive body, is detachable from the main unit 17. This invention is applicable to a system in which the process cartridge is detachable from the developing unit 11 and imaging system main unit 17 independently of the photosensitive body or the other process means, as shown in FIG. 5.

Figure 5:
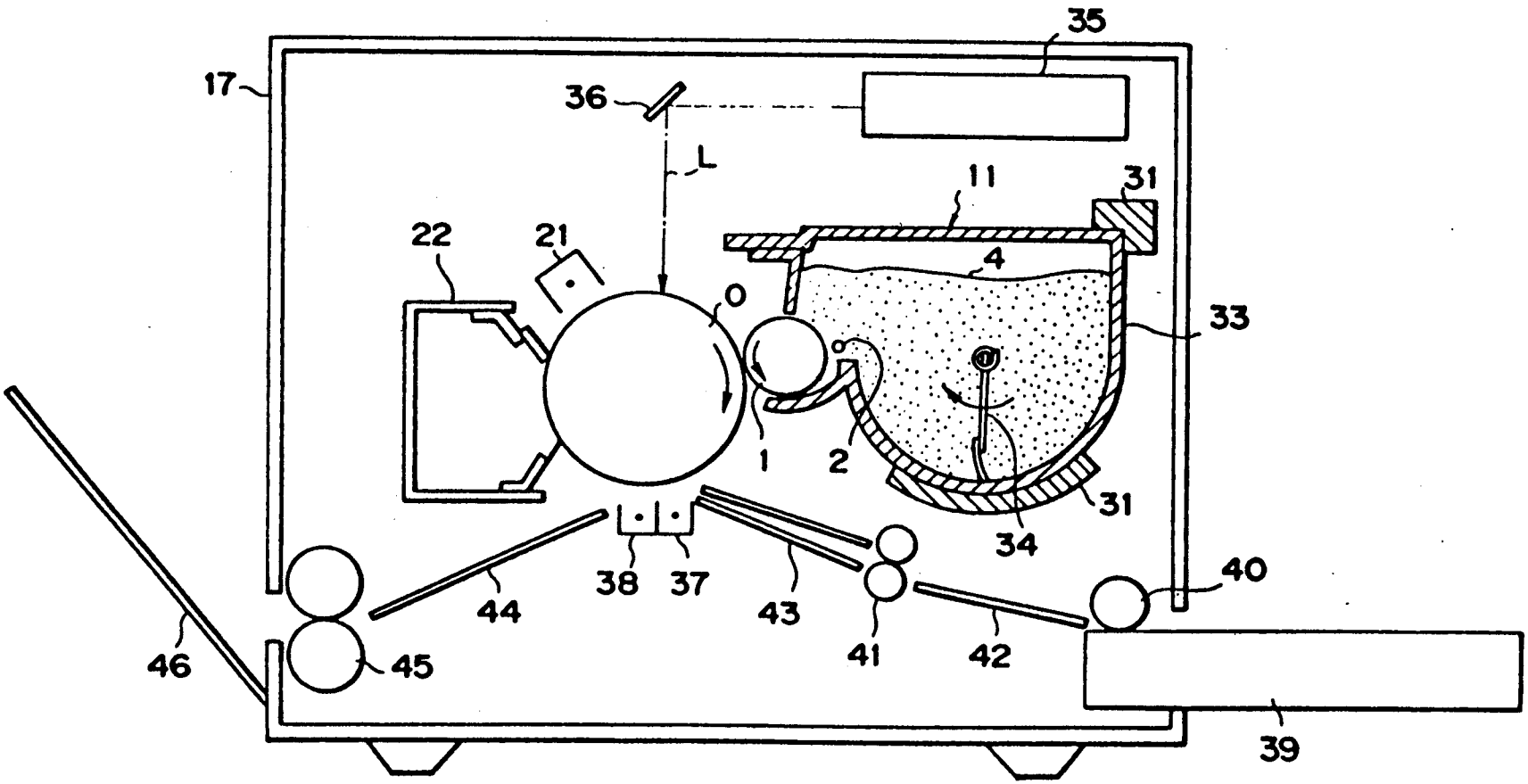
FIG. 5 is an explanatory drawing of another image forming apparatus to which this invention is applicable.

In FIG. 5, the members and means having the same functions as those shown in FIG. 4 are assigned the same signs or numbers, and the description of their operations is omitted.

In FIG. 5, unlike FIG. 4, the developing unit 11 is independent of the photosensitive body o and detachable from the imaging system main unit 17 by sliding it along the guides 31. With this feature, when toner in the developing unit 11 has run out, an operator can extract the developing unit 11 out of the main unit 17 and mount another developing unit 11 whose container 33 is filled with toner into the main unit 17 therefor. When a developing unit accommodating toner of an intended color is mounted into the main unit accommodating toner of an intended color is mounted into the main unit 17, an image developed in an intended color can be formed. The construction for the developing unit 11 shown in FIG. 5 may be the same as that mentioned previously with FIG. 4, which, therefore, is not described here.

This invention can apply not only to the electronic photography type imaging system but also to the developing unit of an imaging system which forms a latent image on an image bearing body by means of an ion flow modulated by an image signal.

In the embodiments described below, the developing unit 11 may be included in the cartridge P as shown in FIG. 4 or freely detachable from the main unit as shown in FIG. 5. The power supply 3, indication circuit 9, detection circuit 12 installed in a single PC board, shielding cable which will be described later, and bias voltage lead wire 20 are fixed to the main unit 17 of the imaging system.

Figure 1:
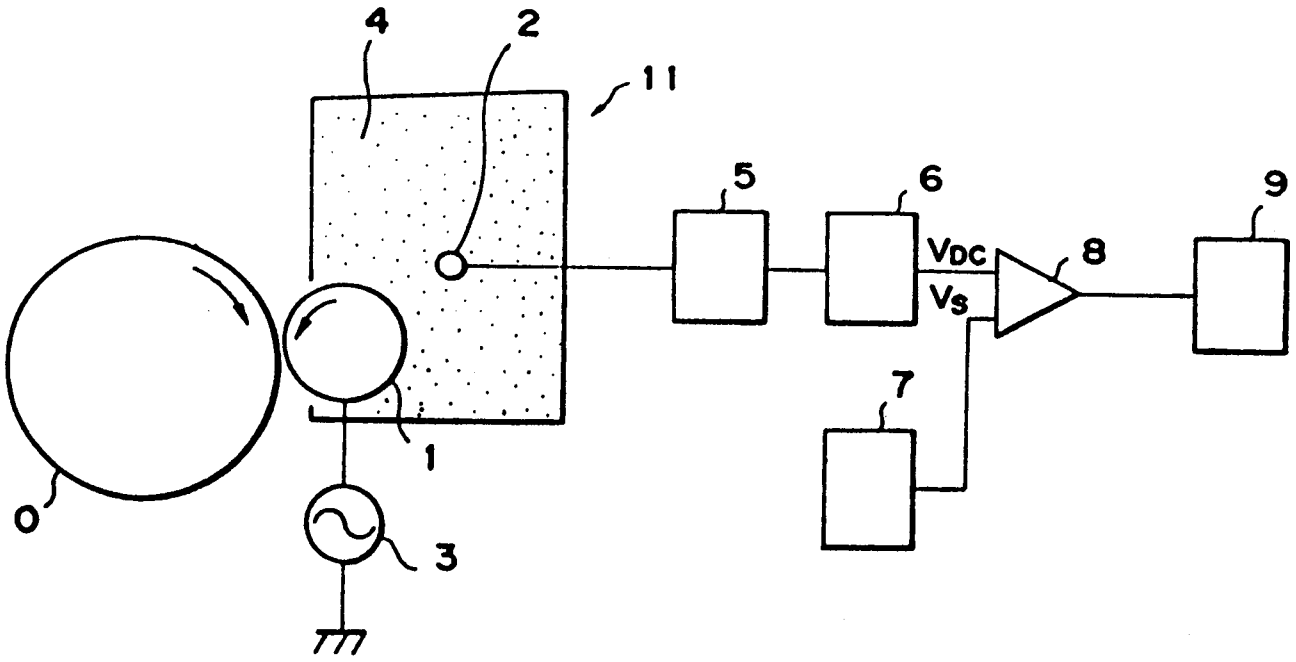
FIG. 1 PRIOR ART
FIG. 1 is an explanatory drawing of prior art.
Figure 2:
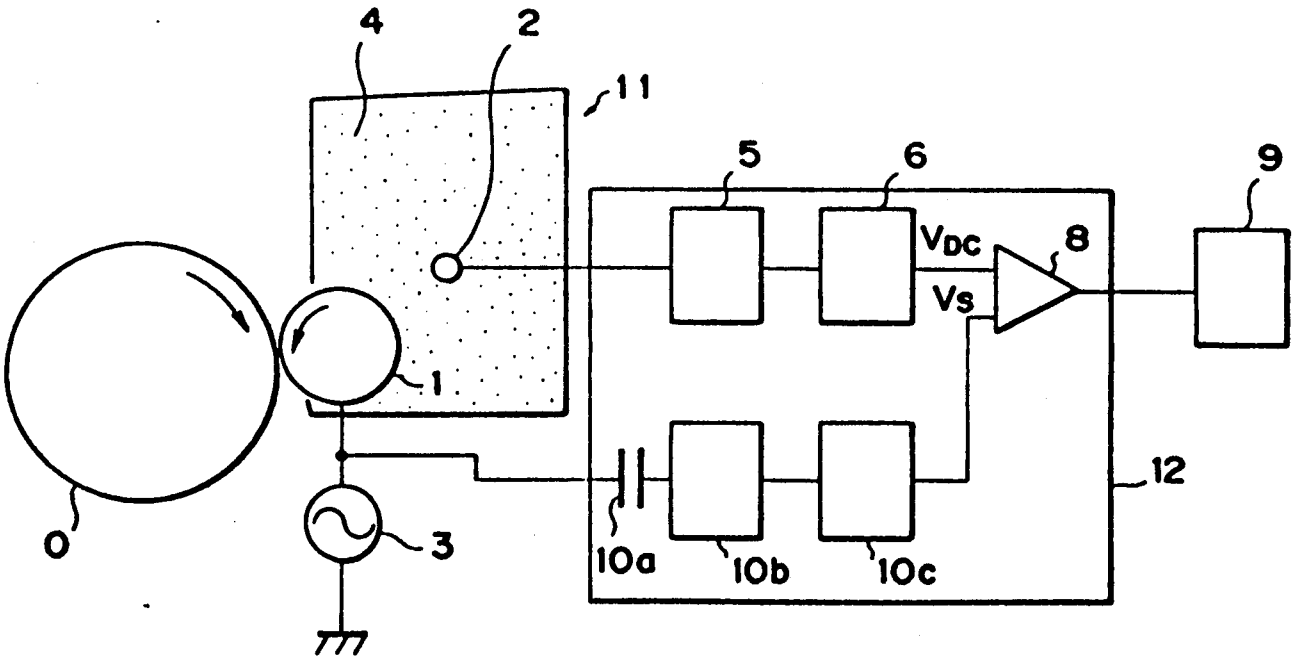
FIG. 2 PRIOR ART
FIG. 2 is an explanatory drawing of another prior art.
Figure 3:
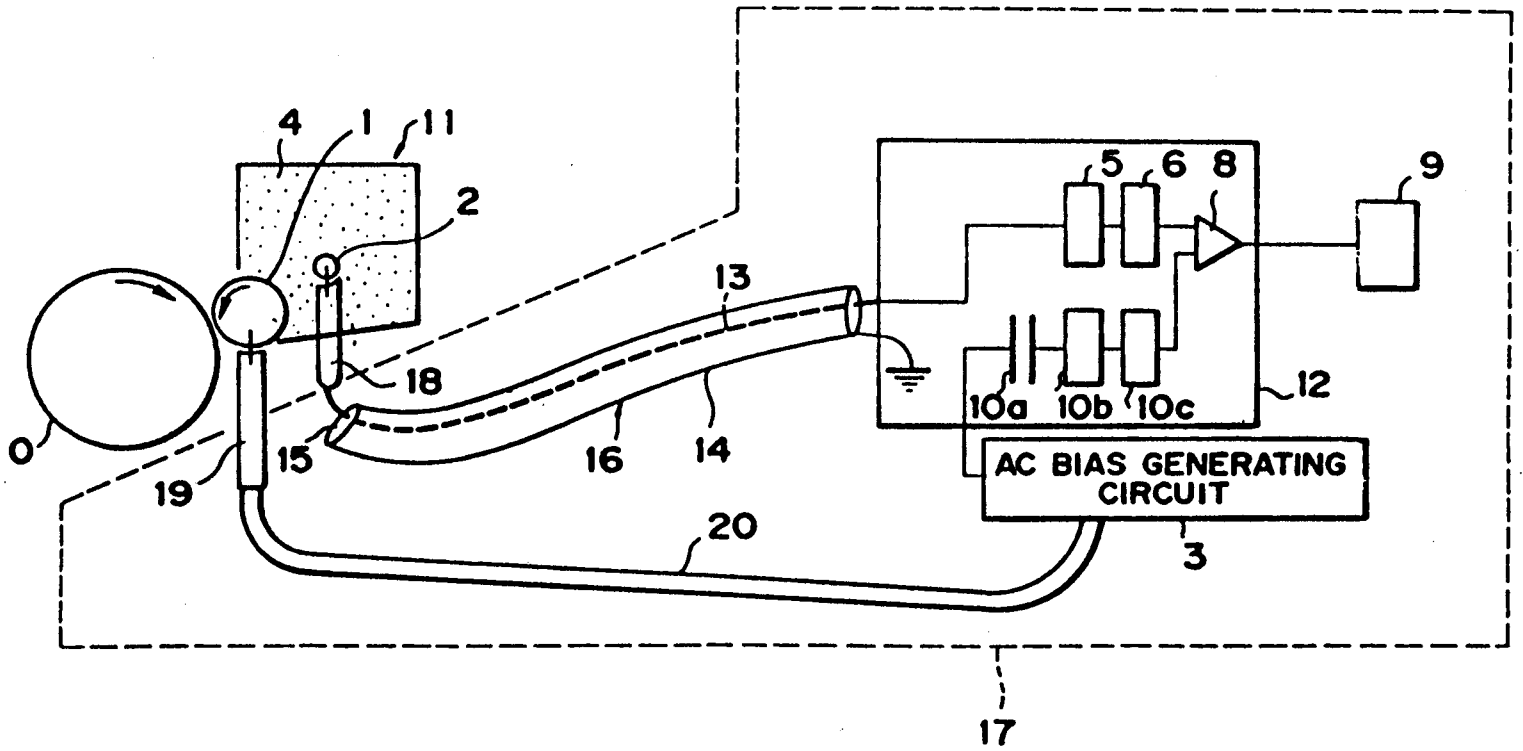
FIG. 3 PRIOR ART
FIG. 3 is an explanatory drawing of yet another prior art.

In the following embodiments, the members having the same functions as those shown in FIGS. 1 to 3 are assigned the same signs or numbers and description thereof is omitted unless it is especially needed.

Figure 6:
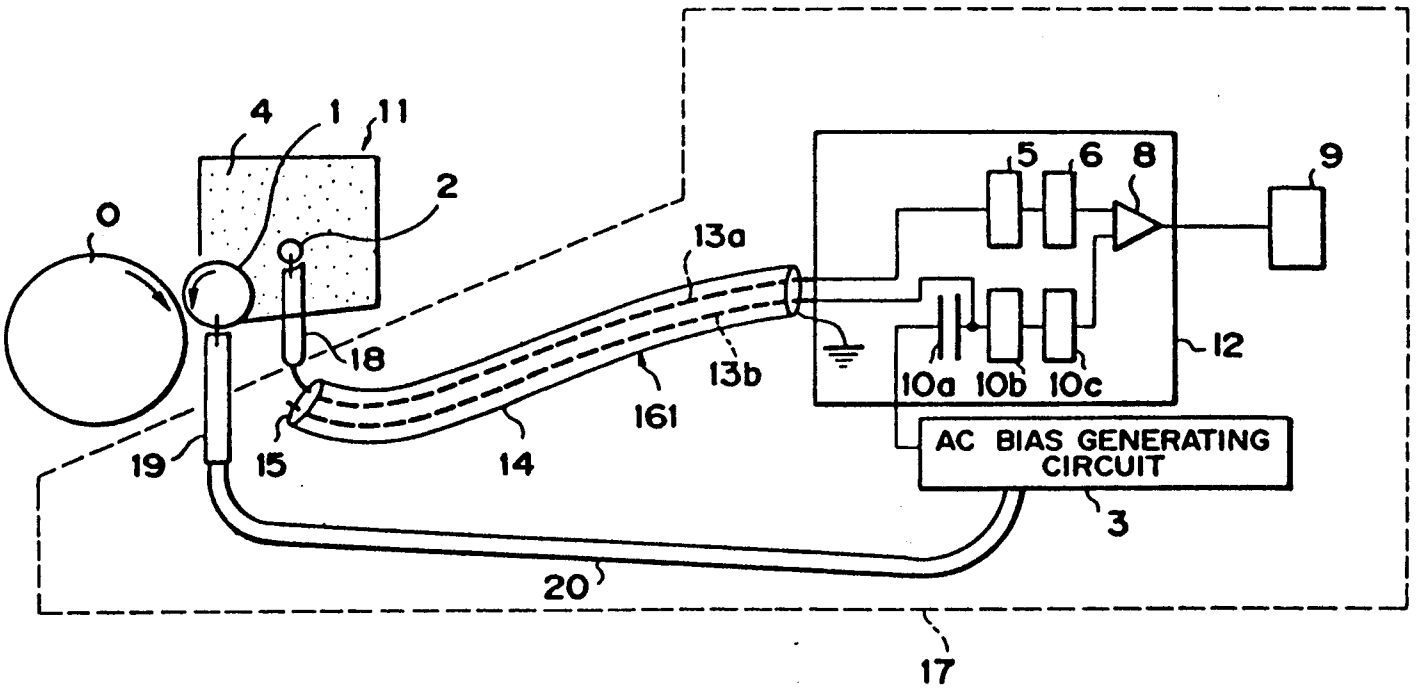
FIG. 6 is an explanatory drawing of an embodiment in which this invention is implemented.

In FIG. 6, 161 represents a twin-core shielding cable. One core wire 13*a* of the twin-core shielding connects the detecting conductor 2 and rectification circuit 5 conventionally. One end of another core wire 13*b* running in parallel with the previous core wire 13*a* is connected to an electrode for voltage output of the capacitor 10*a*, and another end is not connected to any object or electrically open. The floating capacitance between the shielding member 14, and core wires 13*a* and 13*b* is as shown in FIG. 8.

Figure 8:
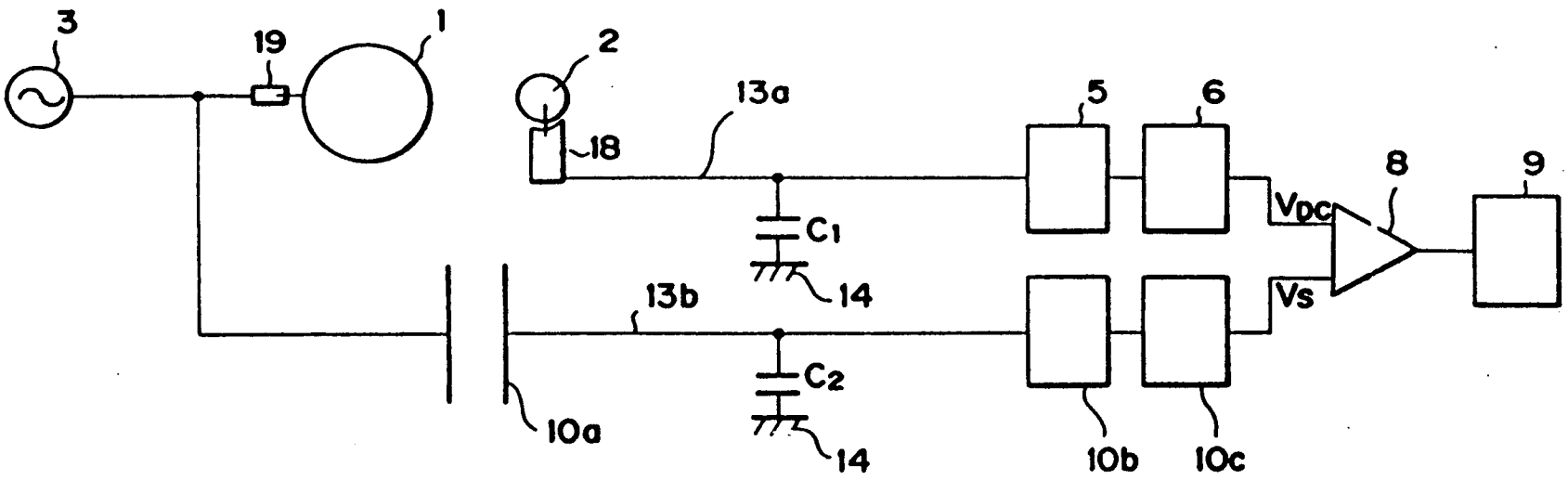
FIG. 8 is an explanatory drawing of principles of this invention.

In FIG. 8, $C_1$ represents the capacitance between the core wire 13*a* and shielding member 14, and $C_2$, that between the core wire 13*b* and shielding member 14. Since the core wires 13*a* and 13*b* have substantially the same length, $C_1$ and $C_2$ represent substantially the same value. Therefore, the shielding cable does not cause a detection error because the detection voltage from the detecting conductor 2 and output voltage from the capacitor 10*a* are influenced by the shielding member 14 in the same manner.

When the core wires or lead wires 13*a* and 13*b* have substantially the same length, it does not mean merely that these wires are exactly the same in length geometrically. Namely, if the geometric length of the wire 13*b* is in the range of 0.85 to 1.15 times long as the geometric length of the wire 13*a*, the detection error prevention effect remains high. Therefore, even in this case, the wires 13*a* and 13*b* are considered to have substantially the same length. Preferably, the length of the wire 13*b* should be in the range of 0.9 to 1.1 times as long as that of the wire 13*a*. More preferably, the length of the wire 13*a* is geometrically identical to that of the wire 13*b*.

Figure 7:
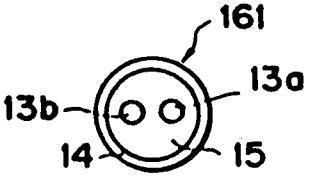
FIG. 7 is a cross-sectional view of a twin-core shielding wire.

In the twin-core shielding cable 161, the core wires 13*a* and 13*b* are running side by side. As shown in FIG. 7, the core wires 13*a* and 13*b* are encapsulated with a flexible insulating material (rubber or synthetic resin) 15. With the insulating material 15, the core wires 13*a* and 13*b* are mutually insulated electrically. Then, the insulating material 15 is encapsulated with an electric shielding member (texture of fine metallic lines). Therefore the shielding member is commonly used for the core wires 13*a* and 13*b*. The shielding member 14 should preferably be electrically grounded.

Figure 9:
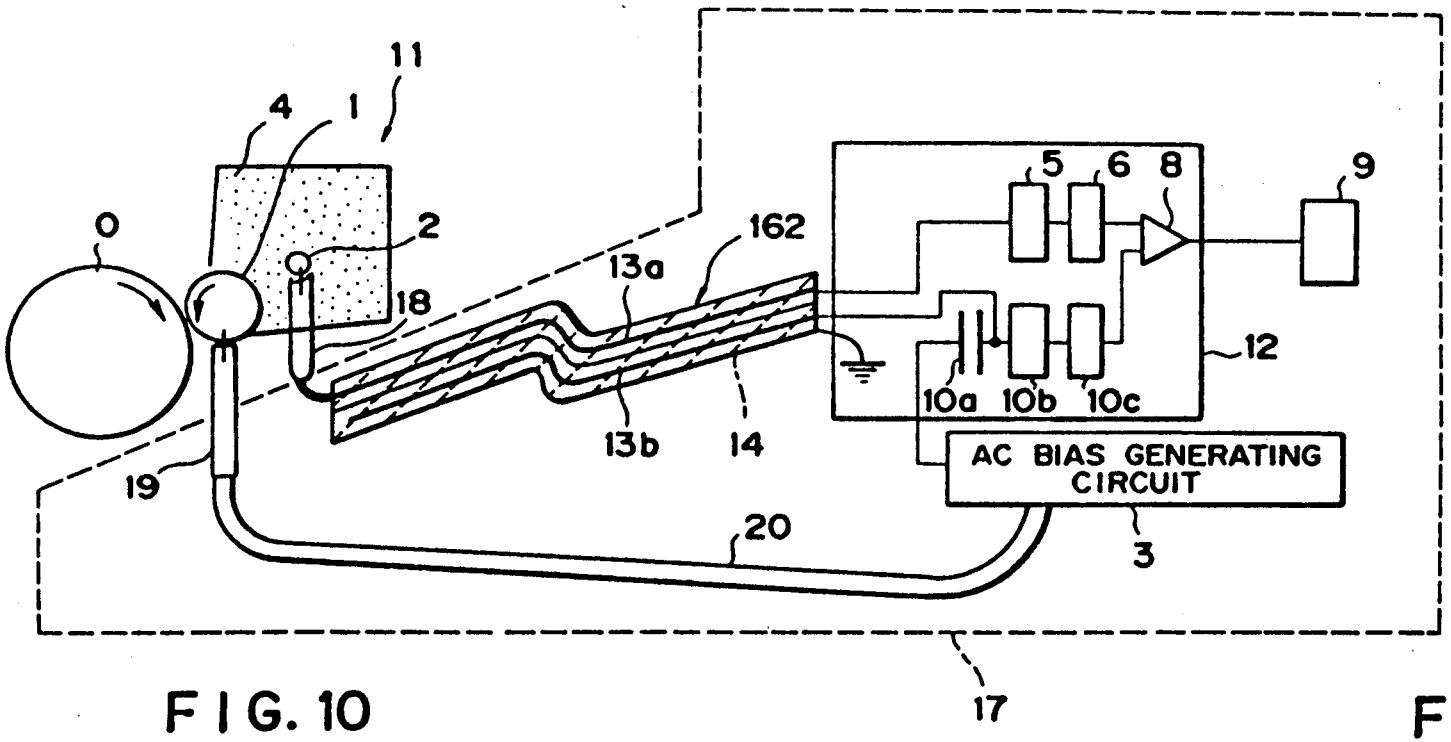
FIG. 9 is an explanatory drawing of another embodiment in which this invention is implemented.

In an example shown in FIG. 9, the flexible circuit PC board (FPC) 162 is open. Two parallel lead wire patterns 13*a* and 13*b* are drawn on the FPC 162. One of them 13*a* connects the detecting conductor 2 and rectification circuit 5. One end of another wire 13*b* is connected to the electrode of voltage output in the capacitor 10*a*, and the other end is electrically open at the location where the length of the pattern 13*b* becomes substantialy the same as that of the other pattern 13*a*.

Figure 11:
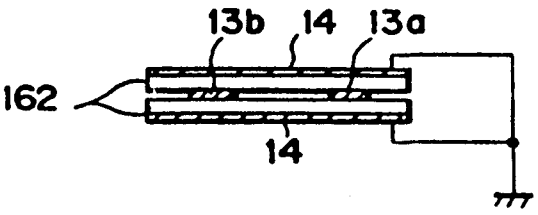
FIG. 11 is a cross-sectional view of another PC board which can be used in FIG. 9.
Figure 10:
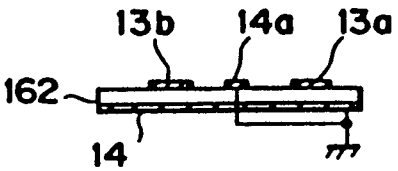
FIG. 10 is a cross-sectional view of a PC board which can be used in FIG. 9.

As shown in FIG. 10, if the pattern 14*a* of a lead wire electrically grounded is drawn between two wire patterns 13*a* and 13*b*, the capacitance between two lead wires 13*a* and 13*b* becomes null, which ensures more stable detection. If a multilayer FPC is used and covered with shielding patterns 14 as shown in FIG. 11, the same shielding effect as that of the shielding cable shown in FIG. 7 is made available. Also in FIG. 11, the pattern 14*a* shown in FIG. 10 can be provided between patterns 13*a* and 13*b*.

Figure 12:
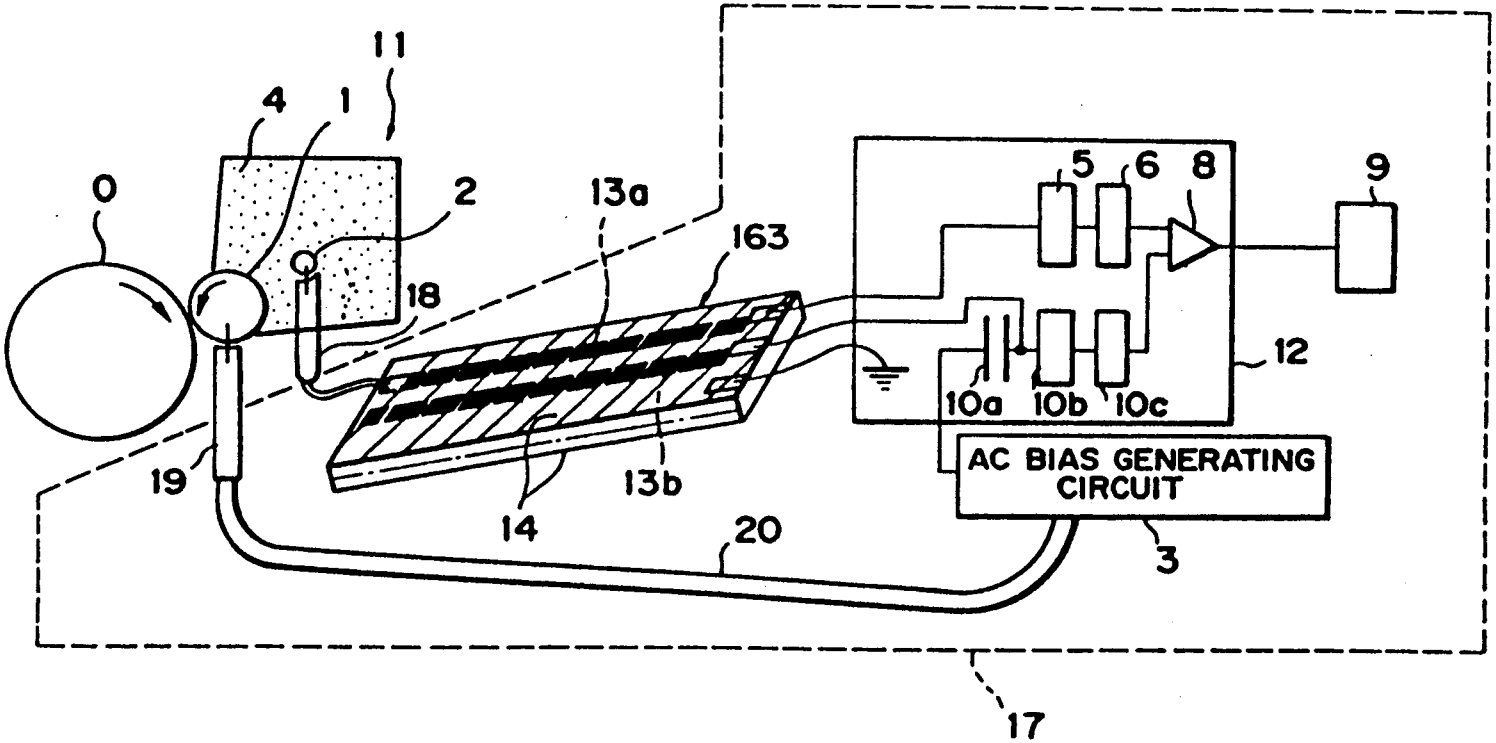
FIG. 12 is an explanatory drawing of another example in which this invention is implemented.

FIG. 12 shows the third embodiment of this invention in which FIG. 12, 163 represents a hard PC board (PCB). The PCB 163 is a multilayer board whose cross section is similar to that shown in FIG. 11. The lead wire patterns 13*a* and 13*b* are installed in an internal layer, and the shielding pattern 14, is external layers. When the PCB is used for wiring and fixed to the main unit 17, detecting efficiency will be further stabilized.

In the above examples, the process cartridge incorporating a developing unit or the developing unit itself can be detachable from the imaging system by an operator. This invention can also apply to the imaging system whose structure does not allow an operator to detach the developing unit from the imaging system main unit. The term "voltage containing an AC component" means voltage having peak values in positive and negative electrodes as well as voltage which oscillates only in the positive or negative electrode.

What is claimed is:

1. An image forming apparatus, having an image bearing member with an electrostatic latent image formed thereon and a developing unit accommodating toner for developing the electrostatic latent image, said image forming apparatus comprising:

a detecting member for generating a detection signal in accordance with an amount of toner in the developing unit;

a first lead wire;

a reference signal generating means for generating a reference signal;

a second lead wire disposed in parallel with said first lead wire, one end of said second lead wire being connected to said reference signal generating means and a second end thereof being electrically open; and comparison means for comparing the reference signal and the detection signal transmitted by said first lead wire.

2. An image forming apparatus according to claim 1, wherein said first lead wire and second lead wire are disposed substantially in parallel with each other and have substantially equal lengths.

3. An image forming apparatus according to claim 2, further comprising an electric shielding member provided in common with said first lead wire and said second lead wire.

4. An image forming apparatus according to claim 3, wherein said electric shielding member is grounded.

5. An image forming apparatus according to any one of preceding claims 1 to 4, further comprising a developer carrying member for supplying toner to the image bearing member and a power supply for generating a bias voltage containing an AC component applied to said developer carrying member, wherein said detecting member comprises a conductor arranged facing said developer carrying member, wherein said detecting member develops an induced voltage in accordance with the amount of toner, and wherein said reference signal generating means produces a reference signal in accordance with the bias voltage generated by said power supply.

6. An image forming apparatus according to any one of preceding claims 1 to 4, wherein the developing unit is detachable from said image forming apparatus.

7. An image forming apparatus according to any one of preceding claims 1 to 4, wherein the image bearing member and said developing unit are detachable in combination from said image forming apparatus.

8. An image forming apparatus, having an image bearing member with an electrostatic latent image formed thereon, a developing unit accommodating toner for developing the electrostatic latent image, and a developer carrying member for supplying toner from the developing unit to the image bearing member, said image forming apparatus comprising:

a power supply for generating a bias voltage having an AC component applied to the developer carrying member;

a detector having a detecting conductor facing the developer carrying member for generating a detecting signal in accordance with an amount of toner in the developing unit;

a reference signal generating means for generating a reference signal;

a first lead wire;

a second lead wire having one end connected to an output of said reference signal generating means and having the other end electrically open, said second lead wire being disposed in parallel with said first lead wire;

an electric shielding member provided in common with said first lead wire and said second lead wire;

comparison means for comparing the detecting signal transmitted by said first lead wire and the reference signal; and display means for displaying an indication that the amount of toner in said developing unit has diminished in response to said comparison means.

9. An image forming apparatus according to claim 8, wherein said first lead wire and said second lead wire are disposed substantially in parallel with each other, and wherein said electric shielding member is grounded.

10. An image forming apparatus according to claim 9, wherein said first lead wire and said second lead wire have substantially equal lengths.

11. An image forming apparatus according to any one of claims 8 to 10, further comprising supporting means for supporting the developing unit detachably.

12. An image forming apparatus according to any one of claims 8 to 10, wherein the developing unit and the image bearing member are supported in combination by a cartridge frame, and wherein said apparatus comprises a main unit having supporting means for supporting said cartridge detachably.

* * * * *

UNITED STATES PATENT AND TRADEMARK OFFICE

CERTIFICATE OF CORRECTION

PATENT NO. : 5,198,860

DATED : March 30, 1993

INVENTOR(S) : HIROMICHI YAMANAKA, ET AL.

It is certified that error appears in the above-identified patent and that said Letters Patent is hereby corrected as shown below:

On the title page:

IN [56] REFERENCES CITED

Under FOREIGN PATENT DOCUMENTS:
"3210870 9/1988 Japan ." should read
--63-210870 9/1988 Japan .--.

COLUMN 1

Line 16, "bias" should read --a bias--.
Line 22, "have" should read --has--.

COLUMN 2

Line 40, "grounded," should read --grounded.--.

COLUMN 5

Line 47, "substantialy" should read --substantially--.

Signed and Sealed this

Seventeenth Day of May, 1994

Bruce Lehman

Attest:

BRUCE LEHMAN

Attesting Officer

Commissioner of Patents and Trademarks